US006959763B2

(12) United States Patent
Hook et al.

(10) Patent No.: US 6,959,763 B2
(45) Date of Patent: Nov. 1, 2005

(54) METHOD AND APPARATUS FOR INTEGRATED HORIZONTAL SELECTIVE TESTING OF WELLS

(75) Inventors: Peter F. Hook, Muscat (OM); Robert M. Ramsey, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 19 days.

(21) Appl. No.: 10/368,881

(22) Filed: Feb. 18, 2003

(65) Prior Publication Data

US 2003/0183385 A1 Oct. 2, 2003

Related U.S. Application Data

(60) Provisional application No. 60/369,165, filed on Apr. 1, 2002.

(51) Int. Cl.[7] ..... E21B 47/00; E21B 43/14

(52) U.S. Cl. ..... 166/250.17; 166/50; 166/66; 166/313

(58) Field of Search ..... 166/250.17, 66, 166/113, 313, 50; 73/152.29, 152.31, 152.36

(56) References Cited

U.S. PATENT DOCUMENTS 4,787,446 A * 11/1988 Howell et al. ..... 166/66.6
4,928,758 A * 5/1990 Siegfried, II ..... 166/66
4,928,759 A * 5/1990 Siegfried et al. ..... 166/65.1
4,937,446 A 6/1990 McKeon et al.
5,045,693 A 9/1991 McKeon et al.
5,055,676 A 10/1991 Roscoe et al.
5,081,351 A 1/1992 Roscoe et al.
5,105,080 A 4/1992 Stoller et al.
5,287,741 A * 2/1994 Schultz et al. ..... 73/152.51
5,699,246 A 12/1997 Plasek et al.
5,832,998 A * 11/1998 Decker et al. ..... 166/185
6,082,454 A * 7/2000 Tubel ..... 166/250.15
6,116,340 A * 9/2000 Wilson et al. ..... 166/250.17
6,192,983 B1 * 2/2001 Neuroth et al. ..... 166/250.15
6,289,283 B1 9/2001 Plasek
6,349,768 B1 2/2002 Leising
6,389,367 B1 5/2002 Plasek
6,478,091 B1 * 11/2002 Gano ..... 166/373
6,604,581 B2 * 8/2003 Moake et al. ..... 166/250.07

* cited by examiner

*Primary Examiner*—Hoang Dang
(74) *Attorney, Agent, or Firm*—Tim Curington; Robin Nava; Dale Gaudier

(57) ABSTRACT

Integrated horizontal selective testing of production flow from individual perforations or individual lateral branches of a highly deviated or horizontal multilateral branch well is accomplished by a downhole flow rate testing tool which is selectively positioned within the wellbore by a coiled tubing deployment system for multiple downhole production flow rate tests to indicate the production flow rates of individual lateral branches or perforated zones. Logging tools are on-board the downhole flow rate testing tool for accuracy of tool location and for conducting downhole production flow rate tests. A multi-phase flowmeter at the surface measures the total production flow rate of fluid flowing in the flowline of the well. Real-time downhole flow measurements are correlated to provide a production flow rate profile. The well operator may take remedial action using on-site equipment if the tests show excessive water or gas from any lateral branch.

15 Claims, 4 Drawing Sheets

METHOD AND APPARATUS FOR INTEGRATED HORIZONTAL SELECTIVE TESTING OF WELLS

CROSS-REFERENCE TO RELATED APPLICATIONS

This application claims priority from U.S. Provisional Application No. 60/369,165, filed Apr. 1, 2002, which is incorporated herein by reference.

BACKGROUND OF THE INVENTION

1. Field of the Invention

The present invention relates generally to methods and apparatus for accomplishing selective production fluid testing of wells to provide a production profile identifying the amount or percentage of oil, water, and gas constituents of the production fluid flowing from wells. More particularly, the present invention is particularly applicable to selective production fluid testing of multilateral branch wells to provide a nearly real-time oil, water, and gas production profile that is available to well operators while the coiled tubing equipment is available at the wellsite, to enable a well operator to make conclusive decisions as to remedial well servicing activities, such as optimal perforation or production zone shutoff when the production profile indicates the presence of excessive water or gas in the well flow.

2. Description of Related Art

When currently used horizontal production logging is being conducted, it has been determined that the acquired logging data is not always conclusive for optimal remedial action. For example, well production can be unstable at the time of logging, thus rendering the logging data quantitatively uninterpretable. Also, the validity of results from existing horizontal production logging services is heavily dependent on the skill and experience of the wireline engineer, particularly in providing an oil production profile. Further, it is not yet possible to determine gas flow rates in horizontal multi-phasic conditions with production logging sensors.

Other well conditions can significantly alter well production profile analyses. For example, sealing one perforation can change the dynamics of well production, so the flow rate profile determined by production logging may not be predictive of the results of remedial action.

Well owners and operators have a present need to take optimal and quick remedial action on cased or open hole laterals of wells when there is an indication of excessive water or gas production. According to present day well logging technology, the well production operator does not become aware of the results of horizontal well production logging until after a detailed and comprehensive interpretation of sensor data has been performed off-site and after the coiled tubing unit has moved off location. There is thus a need for real-time determination of oil, water, and gas production during horizontal production logging services so that the operator of the well can instantly learn of the production characteristics of the well or any particular perforated zone or branch of the well and has the opportunity to take immediate corrective or remedial action while the well servicing equipment is at the wellsite and available for additional logging procedures. With a real-time determination of optimal plug placement and the coiled tubing unit remaining available at the wellsite, the well operator is able to make conclusive decisions as to optimal perforation shutoff, with the coiled tubing unit ready to provide remedial activity for the well.

BRIEF SUMMARY OF THE INVENTION

It is a principal feature of the present invention for multilateral branch wells having highly deviated or horizontal wellbores to provide a novel method and apparatus for accomplishing real-time production flow rate measurement of oil, water, and gas downhole and in selective relation to the intersections of the various lateral branches for determining the production flow rate measurement of the production fluid entering the wellbore from each of the lateral branches and to utilize the production flow rate measurement data to determine if remedial downhole well service is needed to optimize the production of the well.

It is another feature of the present invention to provide a novel method and apparatus for selective testing of multilateral wells for oil, water, and gas production flow rate measurement both downhole and at the surface to identify the production flow rates of fluid entering the wellbore from each of the lateral bores and for real-time and long term production flow rate measurement at the surface.

It is also a feature of the present invention to provide a novel method and apparatus for conducting a plurality of production flow rate measurement tests downhole during a single trip of logging and production testing apparatus into the well.

It is another novel feature of the present invention to provide for utilization of coiled tubing conveyance for a production flow measurement logging tool having a reservoir saturation logging capability for accomplishing real-time production flow rate measurement of oil, water, and gas flowing from lateral branch bores and for measuring fluid flow, if any, past a packer to provide confirmation of the development of a positive packer seal within the wellbore.

It is another feature of the present invention to provide a novel method for accomplishing a real-time oil, water, and gas production profile using a multi-phase flowmeter at the surface, which is connected with the flowline of the well, and utilizing a coiled tubing deployment system for conveying downhole logging and production testing equipment into a well for measuring the production flow rates of individual lateral bores or perforated zones of the well, and in the event downhole remedial activity is indicated, to use the coiled tubing deployment system for conveying well service tools downhole for conducting remedial well servicing operations.

It is also a feature of the present invention to provide a novel logging and production flow testing tool having on board various logging tools, such as a reservoir saturation logging tool (RST), a gamma ray logging tool (GR), a downhole pressure sensor, and a casing collar locator tool (CCL), and with the downhole tool also incorporating a re-settable inflatable packer for sealing within the wellbore in relation to designated lateral bores or perforations for measuring the production flow rates of lateral bores or designated perforations and providing real-time flow rate measurement data.

It is also a feature of the present invention to provide a novel method and apparatus for conducting real-time oil, water, and gas production flow testing of the flow rates from lateral branches of multilateral wells and to use production flow testing data to construct a production profile of the well, which can then be analyzed at the wellsite to determine any remedial well servicing activity that is appropriate, and then to use the coiled tubing conveyance system that is on site to accomplish the desired remedial well servicing activity.

It is another feature of the present invention to provide well operators with instantly available well production profile information, thus enabling the operator to take immediate remedial action using the coiled tubing equipment at the well site, such as accomplishing optimal perforation shutoff of one or more zones of the casing perforations or plugging lateral bores, in the event excessive water or gas flow is determined to be present in the production flow from a particular lateral branch of a well, and to then use the downhole logging and production flow testing tool for confirmation of the success of the remedial action that has been taken.

It is an even further feature of the present invention to provide a novel method and apparatus for production logging using coiled tubing conveyance of downhole logging and production flow testing tools and equipment and which permits the servicing personnel at the well to use the coiled tubing conveyance equipment and accomplish immediate remedial well servicing activity, such as optimal perforation shutoff, in the event the production flow profile of any selected production zone is determined to contain excessive water or gas.

It is also a feature of the present invention to provide a downhole logging and production flow testing tool having a flow-by housing, which allows conveyance and operation of an RST, so as to yield real time information from the RST during running of the downhole tool and real time water velocity measurement while the tool is located at a selected depth or location to enable positive confirmation of sealing of the packer within the wellbore.

It is also a feature of the present invention to provide a novel downhole logging and production flow testing tool having a flow-by housing having one or more compartments that contain one or more logging tools and defines one or more flow passages externally of the logging tool compartment, which permit the flow of production fluid through the housing and externally of the housing compartment containing the logging tools.

Briefly, the various principles of the present invention are realized in general by a method and apparatus for conducting selective horizontal testing of highly deviated or horizontal multilateral branch wells and achieving a real time well production profile of the production flow from individual selected subsurface zones, such as those with a perforated cased lateral or selectively along a barefoot zone, or such as junctions intersected by the various lateral branches of multilateral wells. A multi-phase flowmeter is located at the surface and is connected to the flowline of the wellhead equipment of the well for testing the production fluid flow through the flowline and developing a production profile identifying the respective percentages of oil, water, and gas of the flowing production fluid and further indicating changes in production flow rates over a period of time.

A coiled tubing tool conveyance unit is located at the surface and is used to run and retrieve a well production logging tool having a tool housing containing a plurality of logging tools and having a packer that is inflated or expanded for sealing at selected locations within the cased and perforated wellbore or open hole completion. The tool housing has at least one sealed compartment within which the logging tools are located and defines one or more flow passages externally of the logging tool compartments to permit production fluid flow through the housing even when the tool is sealed within the wellbore by its packer. Various sections of the well tool are "wired", i.e., have wire passages containing electrical conductors that are connected to the various on board logging tools.

The downhole flow rate testing tool and the coiled tubing tool running equipment incorporates the principles of production well logging with the equipment and procedures for the running of downhole tools and equipment with coiled tubing. The coiled tubing is also readily available for running remedial equipment, such as packers, to accomplish remedial activities such as optimal production zone shutoff to thus optimize the production flow rate of the well.

The horizontal selective testing tool has on board several logging tools, including a reservoir saturation logging tool (RST), a gamma ray logging tool (GR), a downhole pressure sensor, and a casing collar locator tool (CCL). The RST and GR measurements are important for depth control to open hole logs. The downhole pressure sensor is important to determine production drawdown on the formation along the lateral. The CCL measurements are important for perforation or lateral branch verification. With the multi-phase flowmeter, surface production rates can be monitored when a re-settable packer is placed between successive perforations or between lateral branches to confirm the production flow rates of the individual lateral branches or individual perforations. The RST achieves production flow measurement downhole and is also used to confirm setting and sealing of the packer by confirming that flow is not occurring when the packer is actuated for sealing Sealing of the wellbore to flow at a desired depth is an essential requirement for the service and must be confirmable at the time of operation to provide confidence that the surface measurements can be related to the sections of the well above the packer inflation point. By inspecting the data of wireline pulsed neutron equipment capable of sensing any water flowing past the packer, the operator is provided with real-time indication that the inflatable packer has provided a seal (provided there is some measurable level of water production from below that point in the well). In order to operate with the inflatable packer, the wireline logging equipment is contained in a flow-by housing designed to permit hydraulic communication. Should it be determined that a seal is not initially effected, repositioning of the packer with the coiled tubing unit is the indicated course of action.

BRIEF DESCRIPTION OF THE DRAWINGS

The present invention may be understood by reference to the following description taken in conjunction with the accompanying drawings in which.

DETAILED DESCRIPTION OF THE INVENTION

With respect to the present invention, terms such as "upper" and "lower" are utilized in this specification to enable the reader to perceive the various components of the apparatus of the present invention. However, since the main wellbore with which the present invention is utilized will be highly deviated or horizontal, and may have lateral bores extending from it, it is intended that the word "upper" mean the upper end of the tool if oriented vertically or the trailing end of the tool assembly, during running, if the tool is oriented substantially horizontally. Likewise, the term "lower" as used herein, is intended to mean the lower end of the downhole tool assembly if oriented vertically, or the leading end of the tool during running if oriented substantially horizontally.

Figure 1:
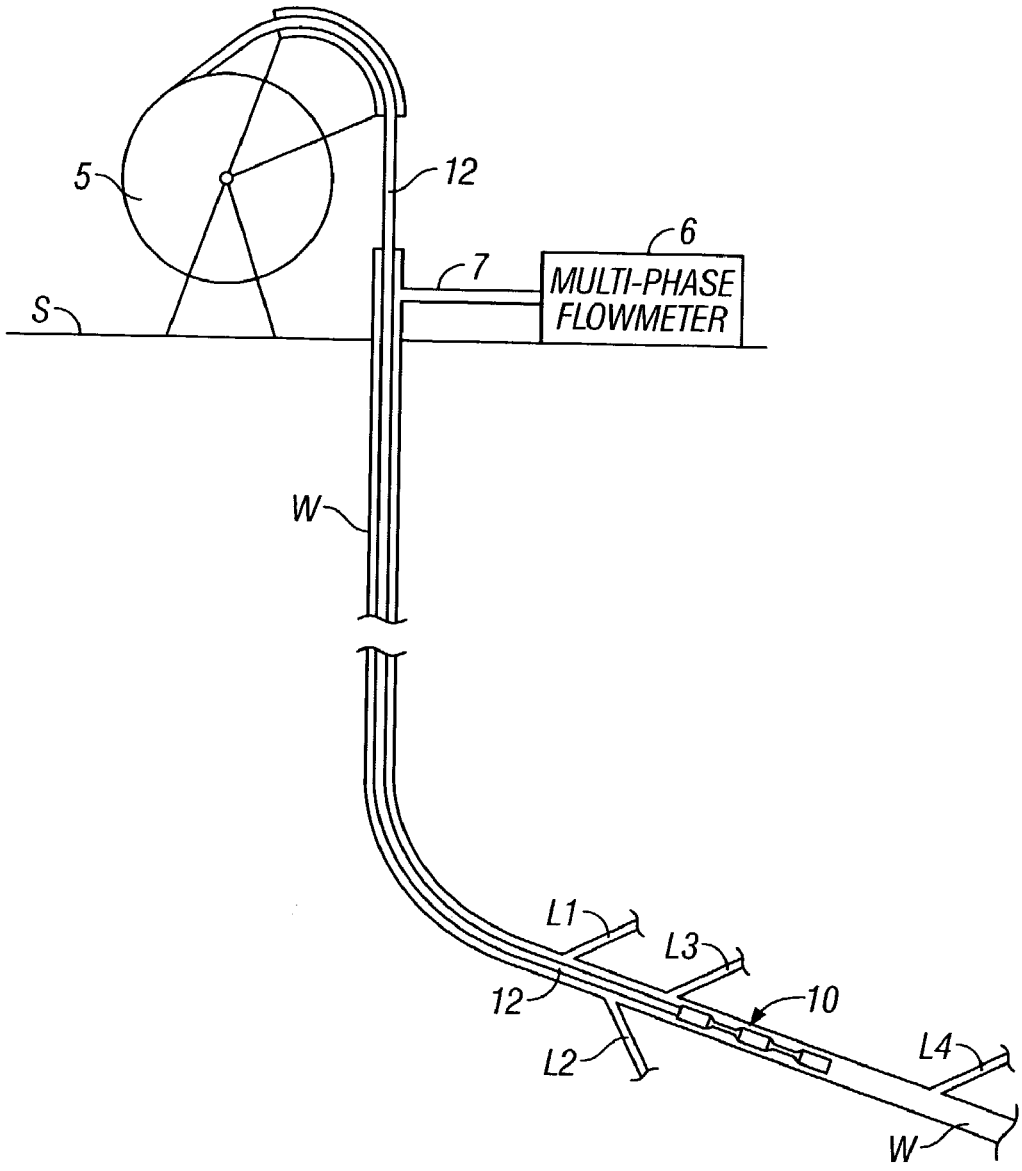
FIG. 1 is a schematic illustration of a multilateral branch well having a plurality of lateral branch bores and further showing the downhole production flow rate testing equipment of the present invention located in the main wellbore and selectively situated in relation to the lateral bores for conducting selective horizontal testing of flow rate production according to the principles of the present invention.

Referring now to the drawings and first to FIG. 1, a coiled tubing unit tool deployment mechanism 5 is located at the surface S, with the coiled tubing string 12 thereof being used to run into the main wellbore W for selectively positioning a horizontal selective testing and logging tool system, generally shown at 10, at selected locations relative to lateral branch bores L1–L4 extending from the main wellbore W. Production fluid flow from the lateral branch bores L1–L4 enters the main wellbore W at points of intersection as shown. The production fluid constituents, such as oil, water, and gas, are often significantly different from each of the various lateral branches of multilateral branch wells. For optimal production of the well, in the event one or more of the lateral branch bores is producing fluid having an excessively high content of water or gas, it may be desirable to plug one or more of the lateral branch bores so that the production of fluid from the remaining lateral branches will contain minimal flow rates of the undesirable constituents. Production flow rate measurements can be taken at the surface by using a multi-phase flowmeter 6 that is connected to the flowline 7 of the well W. However, these flow rate measurements reflect the combined well production flow from all of the lateral branches of the well. Though the multi-phase flowmeter 6 is important to the collection of flow rate data during the horizontal selective testing procedure, and for constructing a production flow rate profile for the well, it is also useful for long term production flow rate testing, to indicate changes in the production of the well. Consequently, the multi-phase flowmeter 6 will often remain at the wellsite after the downhole horizontal selective testing equipment has been removed.

It is desirable to identify the production flow rates of the lateral branches of the well and, if desired, to conduct remedial service activities downhole to terminate the flow from selected lateral branches or perforations so that the total production flow from the well is optimized.

According to the principles of the present invention, a horizontal selective testing and logging tool, identified generally at 10, and also referred to herein simply as the tool or the downhole tool, is run into the well W by means of coiled tubing deployment and is positioned at selected locations relative to the intersection of lateral branch bores L1–L4 relative to the main wellbore W. By so positioning the horizontal selective testing and logging tool system, and by conducting real-time flow rate measurement downhole, the production flow rates from the individual branch bores L1–L4 can be identified. This real-time production flow rate data is presented to the operator or owner of the well, thus enabling a decision to be made at the well site, while the coiled tubing conveyance system is still at the site, for conducting remedial action downhole to optimize the production flow rate of the well. Moreover, if remedial activity is desired, the coiled tubing deployment system that is at the wellsite for flow rate testing can be used for running tools into the well for conducting the desired remedial activity.

Apparatus for conducting downhole production flow measurement on a real-time basis, such as the reservoir saturation logging tool (RST) offered by Schlumberger, have been developed and utilized. A RST, described in U.S. Pat. Nos. 4,937,446; 5,045,693; 5,055,676; 5,081,351; 5,105,080; 5,699,246; 6,289,283; and 6,389,367, each of which is incorporated herein by reference, is typically a wireline deployed tool, and can only be run into wells having a vertical or nearly vertical main bore. Such tools are not run into highly deviated or horizontal wellbores because of the limitations of wireline conveyance. It is desirable, however, to employ a tool or tool component in highly deviated or horizontal wellbores to conduct real-time production flow measurement at selected locations within such wells. This real-time flow rate measurement data is used to identify the production flow rates of the individual lateral bores of the well and thus provide the well operator with an indication of excessive production of water or gas from any of the lateral bores, so that remedial action can be immediately undertaken to optimize well production flow rate.

Figure 2A:
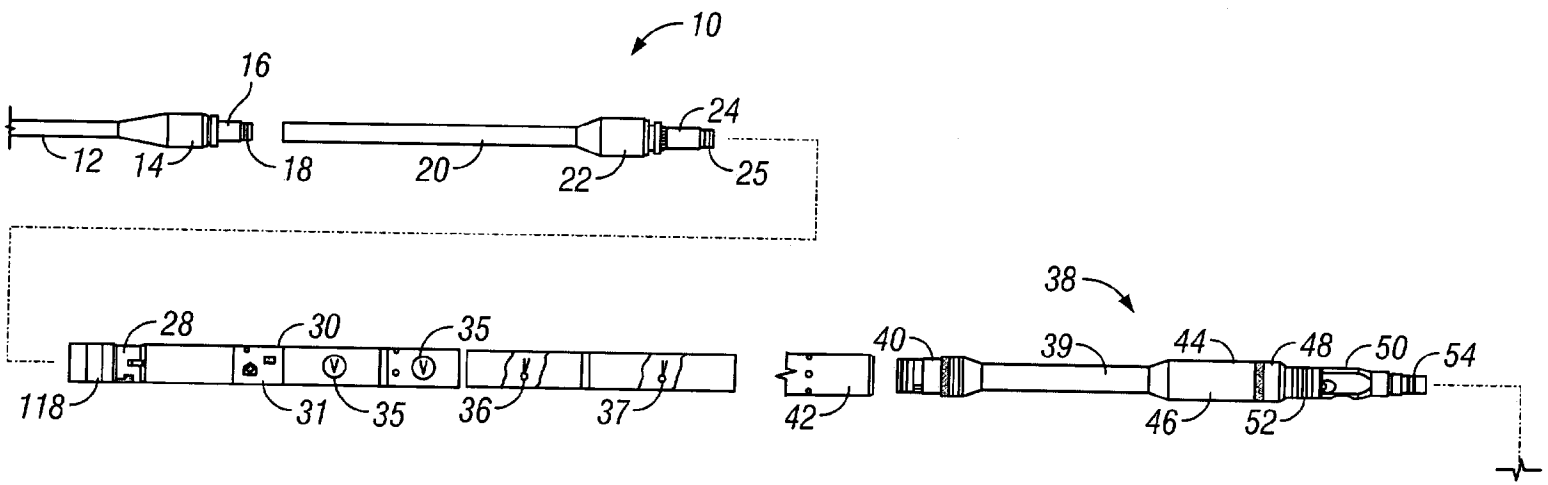
FIG. 2A is an exploded schematic illustration showing the principal components of an upper or trailing section of apparatus of the present invention for conducting real-time production logging of individual branches of a well having multilateral branches.
Figure 2B:
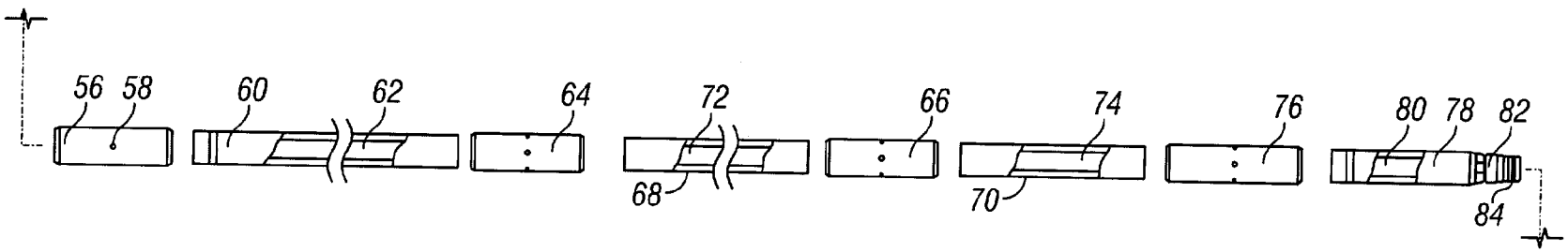
FIG. 2B is an exploded schematic illustration showing an intermediate section of a horizontal production logging system embodying the principles of the present invention.
Figure 2C:
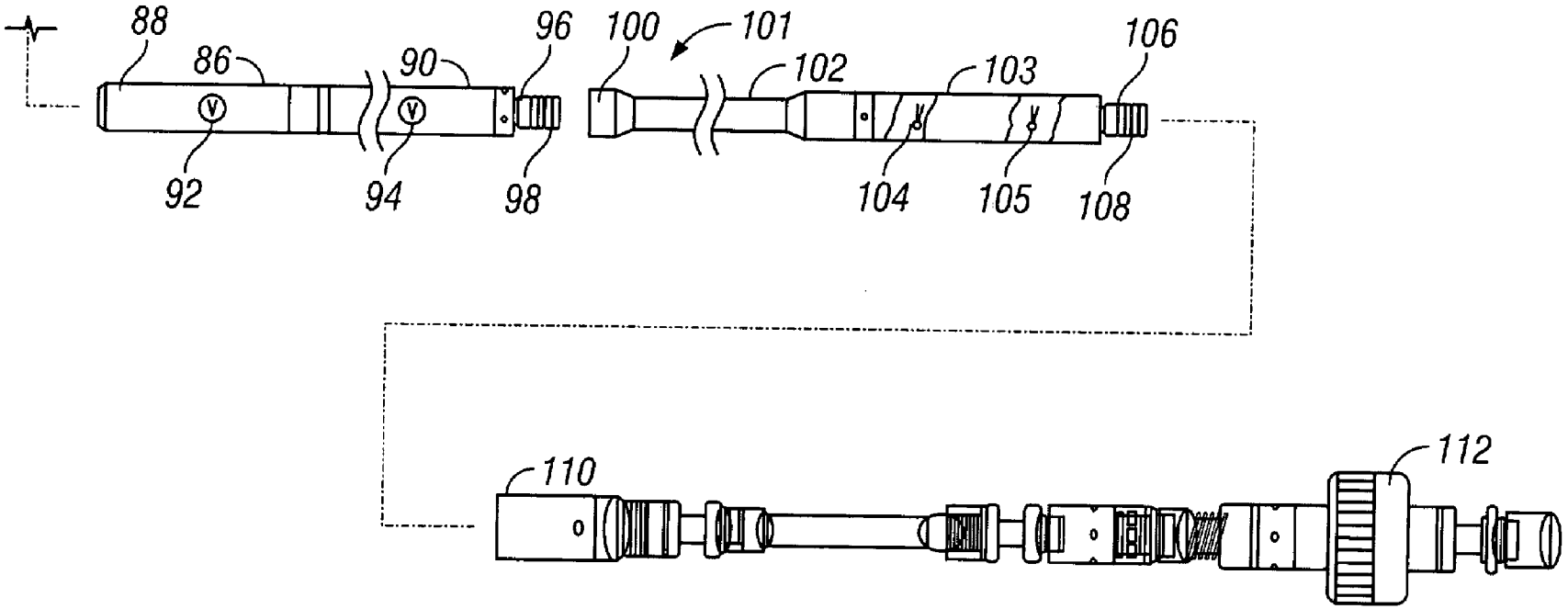
FIG. 2C is an exploded schematic illustration showing the lower or leading section of a horizontal production logging system of the present invention.

Referring now to FIGS. 2A–2C, the horizontal selective testing and logging tool system 10, is adapted to be run into and retrieved from a well by the coiled tubing string 12 by operation of the coiled tubing unit tool deployment mechanism 5. The coiled tubing string 12 has a coiled tubing connector 14 that is provided with a connection projection 16 having one or more seals 18 for sealing within a coiled tubing logging head weakpoint release device 20 including a wired upper quick latch mechanism 22 having electrical conductors for conducting logging signals from the logging tools to signal receivers. The upper quick latch mechanism 22 is provided with a connector projection 24 having one or more seals 25 to provide for mechanically sealed connection and electrical connection with internal wiring conductors of a wired quick latch mechanism 28 of a valve assembly 30 having ball valves 35 and check valves 36 and 37.

A wired upper deployment bar 38 is provided with a coupling projection 40 that is received in sealed relation within the check valve housing 42 of the valve assembly 30. The coupling mechanism of the wired upper deployment bar 38 is provided with electrical conductor couplings that establish electrical connection with wiring conductors of the check valve housing 42 to thus provide for logging signal transition along the connected sections of the tool. Also, the mechanical aspects of the quick latch prevent relative rotation of the upper deployment bar 38 and the valve assembly 30, thus permitting the electrical connectors to remain in signal communication at all times. The wired upper deployment bar 38 is also provided with a lower or leading coupling section 44 which defines a check valve housing 46 so as to define a pressure barrier both above and below the upper deployment bar 38. The intermediate section 39 of the upper deployment bar 38 is of small diameter, preferably the same diameter as that of the coiled tubing 12, so that the rams of a coiled tubing blowout preventer will have the capability of closing either on the coiled tubing 12 or the small diameter intermediate section 39 of the wired upper deployment bar 38 in the event emergency conditions occur. The check valve housing 46 is integral with or connected to a flow-by housing connector 48 having a connector projection 50 that is provided with seals 52 and 54 of differing diameter. The connector projection section with the larger diameter seals 52 provides for sealed connection within a ported sub 56 having one or more ports 58 to provide for production flow interchange. The coupling projection with the smaller seals 54 defines an electrical conductor passage that is isolated when the sealed connection is made. Electrical conductors extend through the electrical conductor passage for connection with an uppermost logging tool 62 located within a sealed chamber so as to be isolated from the production fluid of the well.

The various logging tools that are located within the horizontal selective testing and logging tool system 10 include a reservoir saturation logging tool (RST), a gamma ray logging tool (GR), a casing collar locator tool (CCL), and pressure and temperature sensors. As mentioned above, the GR and CCL provide measurements that are important for depth control to open hole logs. The RST also provides for real-time flow rate measurement, particularly water flow measurement through a wellbore, and also indicates water flow when the packer of the tool is not positively sealed. The CCL is important to depth control in casing lined wellbore sections.

The ported sub 56 is connected with an upper flow-by housing section 60 within which is located the logging tool or logging tool section 62. Flow-by housing couplings 64 and 66 are each employed to provide connection of flow-by housing sections 68 and 70, each containing logging tools or logging tool sections 72 and 74, respectively. Another flow-by housing coupling 76 provides for coupling of the flow-by housing section 70 with a flow-by crossover sub 78, which also contains a logging tool or logging tool section 80.

Wiring, i.e., electrical conductors, transition through each of the flow-by crossover sub 78 and flow-by housing couplings 64, 66, 76 to thus provide for logging signal transmission from each of the logging tools or logging tool sections 62, 72, 74, 80. The flow-by crossover sub 78 also defines a coupling projection 82 supporting a seal assembly 84 for establishing sealed connection with a valve sub 86 having upper and lower valve housing sections 88 and 90 within which are located upper and lower ball valves 92 and 94.

A connector element 96 carrying seals 98 is provided at the lower end of the valve sub 86 and provides sealed connection within a connector element 100 located at the upper end of a lower deployment bar 101 having an intermediate tubular section 102 of small diameter. The intermediate tubular section 102 is preferably of about the same diameter as the diameter of the coiled tubing to permit it to be engaged by blowout preventer rams in the event of an emergency. This second or lower deployment bar 101 is needed because additional tool length below the flow-by housing is needed and because of the need to deploy the tool under well pressure.

It is appropriate for well safety to provide two or more pressure barriers both above and below each of the deployment bars. Thus, a dual check valve assembly 103, comprising check valves 104 and 105, is located at the lower end of the lower deployment bar 101 and provides a connector projection 106 carrying seals 108 for sealed connection with a packer connector 110. A re-settable inflatable packer element 112 is mounted to the packer connector 110 and is inflated to establish sealing with the casing of a lined wellbore or to establish sealing with the wellbore wall in the case of wellbores that are not lined. As mentioned above, when the packer element 112 is actuated for sealing with the well casing or within an open bore, it is necessary to confirm that a positive seal has been established. The RST will provide an indication of production fluid, i.e., water flow when a positive packer seal has not been established. In such case, especially for sealing within open hole bores, the tool system 10 is released and moved and the packer element 112 is again actuated for sealing. When effective packer sealing has been confirmed by the absence of water flow indication by the RST, downhole flow rate measurement can be accomplished by the RST, with measurement parameters being used to provide a real-time indication of the flow rate production of the individual lateral bores.

Figure 3:
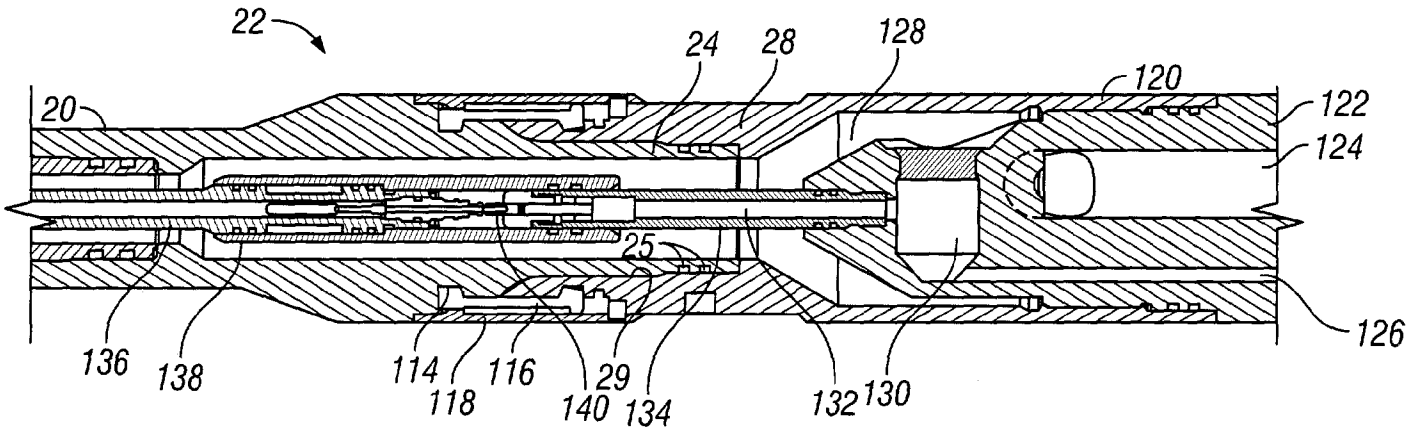
FIG. 3 is a partial sectional view showing the wired quick latch mechanism of the present invention.

Referring now to FIG. 3, which shows the detailed structure of the assembled wired quick latch mechanism 22 of the present invention, the upper quick latch mechanism 22 is of enlarged diameter, as compared with the diameter of the coiled tubing 12 and is provided with a latch mechanism having a latch recess 114 into which portions of a plurality of latch dogs 116 are received when the upper and lower latch mechanisms are engaged. A retainer sleeve 118 is carried by the lower quick latch member 28 and is linearly movable between a latching position, shown in FIG. 3, and a retracted position permitting releasing movement of the latch dogs 116. The lower quick latch member 28 defines an internally threaded tubular section 120 into which is threaded a connector body member 122 having an externally threaded section and defining a fluid flow path or passage 124 and a wire path or passage 126. With the connector body member 122 threaded into the internally threaded tubular section 120 as shown in FIG. 3, the fluid flow path 124 is in communication with an internal fluid flow annulus 128 and the wire path 126 is in communication via a sealed access bore 130 with a wire passage 132 of a tubular electrical connector pin 134. The tubular electrical connector pin 134 and a connector conduit member 136 each have electrical connection ends received within a connector sleeve element 138 within which one or more electrical contact pins 140 are also located. When the quick latch mechanism 22 is unlatched and separated, the connector sleeve element 138 is retracted along with the connector projection 24, thus separating the electrical contacts and permitting the tubular wire passage member 134 to remain in assembly with the connector body member 122. The fluid flow path 124 is in communication with the flow-by passage of the upper flow-by housing section 60, thus permitting fluid flow through the tool 10 simultaneously with logging production fluid composition during production fluid flow from a designated lateral wellbore or perforated zone.

Figure 4:
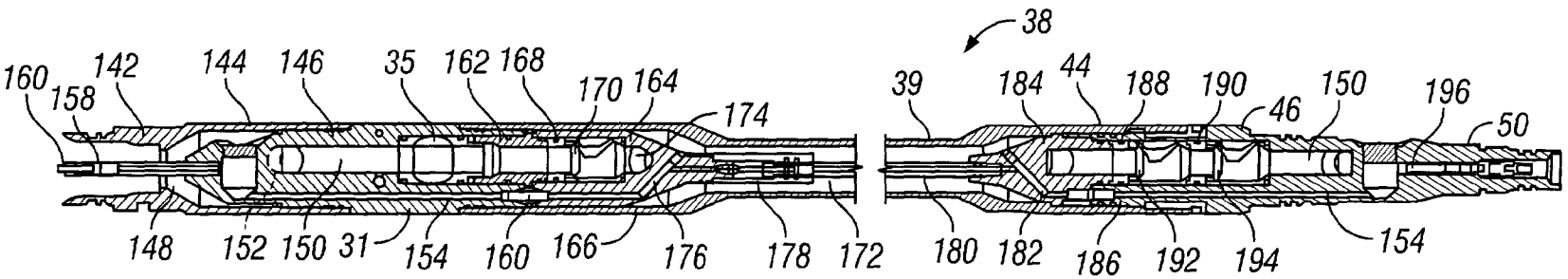
FIG. 4 is a sectional view showing the wired deployment bar of the present invention in detail.

Referring now to FIG. 4, the sectional view illustrates the details of the wired upper deployment bar 38 of FIG. 2A, and shows the fluid flow passage arrangement and the electrical conductor wire passage arrangement of the wired deployment section of the tool 10. A connector sub 142 defines an internally threaded receptacle 144, within which is threadedly secured the upper externally threaded end section 146 of the connector and valve body member 31. The connector sub 142 and the connector and valve body member 31 define an annulus fluid flow passage 148 that is in communication with a flow passage 150 via a fluid passage intersection shown in broken line at 152. The connector and valve body member 31 also defines a wire passage 154. The wire passage 154 is in communication with a wire passage that is defined by a tubular connector pin 158. An electrical conductor or cable of multiple conductors extends from an electrical contact pin through the wire passage 154. At body joints, tubular wire passage elements, such as shown at 160, isolate the wire passage from the pressure of the production fluid flow through the tool. The connector and valve body member 31 also defines a valve chamber intersected by the fluid flow passage 150 and containing the ball valve 35. A tubular retainer member 162 is at least partially received within the valve chamber and serves to retain the ball valve 35 in proper position. A lower body section 164 is located within a tubular coupling section 166 of the wired upper deployment bar 38 and serves to secure the tubular retainer member 162 in position and to maintain a check valve seat 168 seated against the tubular retainer member 162. A check valve member 170 is movable relative to the check valve seat 168 and is operative for closing contact with the check valve seat 168 under the influence of predetermined velocity of production fluid flow within the flow passage 150. The flow passage 150 crosses over from the central portion of the tool to the annulus 172 via a connecting passage 174 while the wire passage 154 transitions to the central portion of the tool via passage section 176 and extends into a tubular electrical connector pin 178 which is at least partially located within the small diameter intermediate section 39 of wired upper deployment bar 38. The wire passage also extends through another tubular electrical connector member 180 which is connected in sealed relation to the tubular electrical connector pin 178 and also passes through a passage section 182 of a flow diverter body 184 where the fluid flow passage is transitioned to the central portion of the tool and the wire passage is again transitioned to the outer portion of the tool. The check valve housing 46 includes a tubular connector section 186, which is located within and in sealed relation with the lower or leading coupling section 44. A pair of check valve seats 188 and 190 are mounted within the tubular connector section 186 and check valve elements 192 and 194 are movable to sealed relation with the respective valve seats by predetermined fluid flow within the flow passage 150 of the tool. At the tubular connector projection 50 the fluid flow passage 150 and the wire passage 154 again crossover to permit electrical connection and fluid flow communication with the upper flow-by housing section 60 of the tool. The connector projection 50 of the wired upper deployment bar 38 has an electrical connector 196 located within the wire passage 154, which establishes electrical connection with the electrical conductors of the various logging tools when wired upper deployment bar 38 is assembled with the flow-by housing assembly.

Method of Operation

Integrated horizontal selective testing of production flow from individual perforations and/or multilateral branch wells is accomplished by locating a multi-phase flowmeter 6 at the surface and connecting it to the production flowline 7 of the wellhead equipment as shown in FIG. 1. The multi-phase flowmeter 6 accomplishes continuous monitoring of the constituents, i.e., oil, gas and water, such as brine, of production fluid flowing through the production flowline 7 on a long term basis to indicate changes in the production flow rate of the well over time. This total well production flow rate data is important to confirm well flow or lateral branch flow during the testing procedure and to confirm the success of any remedial action that has been taken.

It is desirable, however, to accomplish real-time production flow rate measurement downhole to identify the production flow rate of individual lateral branches or perforated zones and to permit optimization of well flow rate production if indicated to be appropriate. Because production fluid in multilateral wells is typically flowing from production zones intersected by one or more lateral branches, and typically a plurality of lateral branches, one or more of which may be producing excessive volumes of water or gas, it is desirable to identify the production flow rates of each of the lateral branches of the well to enable well operating personnel to decide on remedial action to optimize the production from the well. To accomplish downhole production flow measurement at a number of downhole locations, the horizontal selective testing and logging system 10 is run into the well by coiled tubing conveyance, thus enabling accurate positioning of the tool in the highly deviated or horizontal wellbore. A re-settable inflatable packer element 112 of the tool is then set in the main wellbore W at selected locations relative to the intersection of lateral bores with the main wellbore W, thus positioning the downhole flow rate measurement tool for measurement of production fluid flow at any selected location within the main wellbore W from one or more lateral branch bores or from specific perforations. Production flow rate data from these selected locations are used to identify the production flow rates of the individual lateral bores or individual perforations. After all of the test measurements have been completed, the tool is retrieved from the well by the coiled tubing conveyance system.

Most importantly, after the downhole production flow rate testing has been completed and the downhole tool has been retrieved from the well, the coiled tubing equipment at the surface will be readily available at the well site for setting packers or plugs within one or more lateral branches to exclude the undesirable production flow rate from the total production flow rate of the well. Having the coiled tubing deployment system readily available at the well site significantly minimizes the cost of any remedial well servicing that is indicated.

The selective horizontal production flow rate testing procedure can then be repeated for all of the lateral branches of a well and all of the selected perforations as the horizontal selective testing and logging system is sequentially moved up the wellbore W from the bottommost lateral branch or perforated zone. In the event the wellbore is not cased, the horizontal testing method can be conducted in the same manner as discussed here and through the use of the same or similar equipment, by setting packers in the open hole bore at selected locations relative to individual lateral branches or perforated zones.

Use of the apparatus or tool described above in conducting horizontal selective production logging of highly deviated or horizontal multilateral wells comprises the following:

A coiled tubing conveyance system 5 is connected to the horizontal selective testing and logging system 10 at the surface. The multi-phase flowmeter 6, being a multi-phase fluid flow tester having a venturi flow meter to measure total mass flow rate and dual energy gamma ray composition meter to measure oil, water, and gas fractions, is connected into the production flowline 7 of the well to provide for long term monitoring of the oil, water (brine), and gas rates of the production flow from the well and to identify any changes in the total production flow rate of the well.

To measure the production flow rates of the individual branch bores of the well according to the present invention, a coiled tubing conveyance system 5 is connected to the horizontal selective testing and logging system 10 and is utilized to position the tool 10 within the well. Since the well will typically be a highly deviated or horizontal well, coiled tubing conveyance is necessary for accurate positioning of the downhole tool 10 in desired relation to the intersections of lateral branch wellbores with the main wellbore. The horizontal selective testing and logging system 10 incorporates a reservoir saturation logging tool and thus accomplishes real-time measurement of the production flow rate that is occurring at any selected location within the main wellbore. By selectively locating the downhole production flow rate logging tool in relation to each of the lateral branch bore intersections or in relation to selected perforations, the production flow rate of the individual lateral branches is measured and recorded, and being real-time measurements, the recorded data is immediately available at the surface for inspection by well operating personnel. In the event the real-time production flow rate measurements indicate any of the lateral bores is producing excessive water or gas, the well operator can decide to take remedial action as needed to optimize the total production flow rate of the well.

The horizontal selective testing and logging system 10 incorporates a coiled tubing logging head having passages therethrough for production fluid flow and for one or more electrical logging conductors, typically referred to as "wired for flow through". Below the coiled tubing logging head is connected a weakpoint release device 20, that is also wired for flow through, and with a wired upper quick latch 22 and a wired lower quick latch 28 connecting the coiled tubing logging head to a wired upper deployment bar 38 having pressure barriers at both the upper and lower ends thereof, which are defined by ball valves and check valves.

The horizontal selective testing and logging system 10 also comprises a flow-by housing having one or more sealed compartments containing a plurality of logging tools for conducting logging operations both during running of the tool and during static location of the tool for restricting the production flow through the flowline to the production flow entering the well from a selected subsurface production zone. The on-board logging tools of the tool 10 include a reservoir saturation tool (RST) for water velocity measurement, a pressure sensor, the measurement of which is specially ported to the external surface of the flow-by housing 60 through port 58, a gamma ray logging tool (GR) and a casing collar locator (CCL). The flow-by housing also defines one or more fluid flow passages located externally of the sealed compartment or compartments within which the logging tools are located and providing for production fluid flow even when the tool is statically located and sealed within the wellbore.

During coiled tubing conveyance of the downhole tool system, recording of RST, GR, pressure, and CCL log data occurs as the tool is moved along the wellbore and the depths of the recorded log data being acquired are correlated with any log data that has been previously acquired in the wellbore. This is done to achieve confirmation of the depths of lateral branch intersections with the main wellbore, as well as the depths of perforations from the CCL, assuming the wellbore is cased, and also to determine the flowing pressure profile of the well prior to isolation of laterals or perforated zones. When the desired depth has been reached, the packer is then positioned at a first pre-selected depth, and is set, i.e., sealed, just above the intersection of the bottommost lateral bore with the main wellbore or above the bottommost perforated zone in the event of a cased wellbore. With the tool in this position, timed recording of a downhole borehole pressure sensor is initiated and a RST water flow log (WFL) measurement is also initiated and recorded.

The packer of the tool is inflated and sealed to the wellbore casing or open bore wall at this point, while monitoring water flow and borehole pressure. In the event water flow is detected, thus indicating that a packer seal has not been accomplished, the horizontal selective testing and logging system, and thus the packer, is repositioned along the wellbore as needed to effect, and by water velocity measurement, or lack thereof, confirm a positive packer seal. Upon acquisition of confirmation of a successful packer seal, stabilization of the multi-phase flowmeter surface flow rates is monitored for determination of well contribution from any lateral bores intersecting the main wellbore above the packer. The selective horizontal flow rate testing procedure is repeated, with the downhole tool being moved successively up the main wellbore between each production flow test until the production flow rates of each of the lateral branches is identified. To ensure consistency in drawdown while performing the successive tests, and thus coherency in establishing the production profile, the surface production of the well is adjusted to ensure that the recorded pressure from the downhole sensor after packer inflation matches the initial borehole pressure recorded earlier at that particular depth and under open flowing condition along the length of the borehole. The production flow testing procedure for the well is complete when a determination is made of the production flow rates of each of the lateral branches.

Using data from the successive stabilized production flow rate tests, a substantially real-time oil, water, and gas production profile is built, representing the production flow rates of all of the lateral bores. This oil, water, and gas production profile, which is available at the well site immediately upon completion of the testing procedure, is reported to the oil company or other operator of the well, for decision on remedial action, if any, for optimizing well production. If remedial activity is deemed necessary, the horizontal selective testing and logging system is removed from the well, and the coiled tubing mechanism is then used to perform remedial work to optimize the total production flow rate of the well. Following such remedial action, the horizontal selective flow rate testing procedure is repeated, with the downhole tool being moved successively up the main wellbore between each production flow test, until the production flow rates of each of the lateral branches has again been identified to verify the results of the remedial action.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the scope of the invention as defined by the appended claims.

We claim:

1. A method for integrated horizontal selective testing of highly deviated or horizontally completed wells having one or more perforated zones and/or cased or open hole lateral branches to provide substantially real-time measurement of the production flow rates of a plurality of the perforated zones and/or lateral branches, comprising:

with a coiled tubing deployment system, positioning a downhole flow rate measurement tool having a production flow rate measurement capability at a selected location within the wellbore relative to a selected perforated zone or lateral branch;

with the downhole flow rate measurement tool measuring the production flow rate of the production fluid at the selected location;

successively moving the downhole flow rate measurement tool to other selected locations within the wellbore and conducting other production flow rate measurements; and correlating the flow rate measurement data of each of the production flow rate measurements for confirming the production flow rates of each of the perforated zones and/or lateral branches.

2. The method of claim 1, further comprising:

utilizing flow rate measurement data of each of the production flow rate measurements and constructing a production flow rate profile.

3. The method of claim 1, further comprising:

in the event the production flow rates of the perforated zones and/or lateral branches indicates the need for remedial activity downhole, un-deploying said downhole flow rate measurement tool; and deploying remedial equipment with said coiled tubing deployment system and conducting remedial activity within the well.

4. The method of claim 1, further comprising:

connecting a multi-phase flowmeter into the flowline of the well; and with the multi-phase flowmeter measuring the total production flow rate of the production fluid flowing through the flowline both during downhole flow rate measurement and for identifying changes in the production flow rate of the well after downhole flowrate measurement has been completed.

5. A method for integrated horizontal selective testing of highly deviated or horizontally completed wells having one or more perforated zones and/or cased or open hole lateral branches to provide substantially real-time flow rate measurement of production fluid of a plurality of the perforated zones and/or lateral branches, comprising:

with a coiled tubing string, positioning a downhole flow rate measurement tool having at least one re-settable packer and having a production flow rate measurement capability at a selected location within the highly deviated or horizontal wellbore relative to a selected perforated zone or lateral branch;

setting the re-settable packer within the wellbore at the selected location and confirming sealing of the packer within the wellbore;

with the downhole flow rate measurement tool, measuring the production flow rate of the production fluid at the selected location;

successively moving the downhole flow rate measurement tool to other selected locations within the wellbore, setting and confirming sealing of the packer, and conducting other production flow rate measurements; and utilizing flow rate measurement data of each of the production flow rate measurements for confirming the production flow rates of each of the perforated zones and/or lateral branches.

6. The method of claim 5, further comprising:

connecting a multi-phase flowmeter into the flowline of the well to provide total production flow measurement identifying the total flow rates of oil, water, and gas of the production fluid flowing through the flowline.

7. The method of claim 5, further comprising:

with the coiled tubing string, retrieving said downhole tool flow rate measurement tool from the well; and with the coiled tubing string, conducting remedial downhole servicing activities to optimize well production.

8. The method of claim 7, comprising:

with the coiled tubing string, setting one or more packers and accomplishing optimal production zone shutoff.

9. The method of claim 5, wherein the downhole flow rate measurement tool has at least one logging tool and has a flow-by housing containing the logging tool and permitting production fluid flow past the logging tool, said method further comprising:

conducting well logging operations with said at least one logging tool during running of said downhole flow rate testing tool and during production flow for accurately positioning said downhole flow rate measurement tool and for selective measurement of individual production flow rates of selected perforated zones and/or lateral branches of the well.

10. The method of claim 9, wherein said at least one logging tool is a reservoir saturation logging tool, a gamma ray logging tool and a casing collar locator tool, said method comprising:

during running of the downhole flow rate measurement tool, recording gamma ray and casing collar locator log data along the wellbore.

11. The method of claim 10, further comprising:

during running of the downhole flow rate measurement tool, correlating depths of recorded data with log data previously acquired within the wellbore.

12. The method of claim 10, further comprising:

during running of the downhole flow rate measurement tool, confirming the depths of the perforations from the recorded data of said casing collar locator tool.

13. The method of claim 5, comprising:

with the downhole flow rate measurement tool located within the wellbore, measuring and recording the production flow rates of oil, water, and gas flowing from one or more perforated zones and/or lateral branches.

14. The method of claim 5, comprising:

with the downhole flowrated measurement tool located within the wellbore, with the coiled tubing string selectively positioning the downhole tool for location of the re-settable packer at a first pre-selected depth nearest the top of the bottommost perforation of the well;

after measuring and recording the production flow rate at the selected depth, successively moving the downhole flow rate measurement tool upwardly to desired locations within the wellbore and measuring the production flow rates at the desired locations; and correlating production flow rate data of each production flow rate measurement for identification of the production flow rates of selected perforated zones and/or lateral branches.

15. A method for integrated horizontal selective testing of highly deviated or horizontal wells having one or more perforated zones and/or lateral branches to provide real-time oil, water, and gas production flow rate measurement from selected perforated zones and/or lateral branches, comprising:

connection of a surface located multi-phase flowmeter into the flowline of the well, the multi-phase flowmeter measuring the rates of oil, water, and gas flow through the flowline and providing real-time production flow data;

using coiled tubing, conveying a downhole flow rate measurement tool into the well, the downhole flow rate measurement tool comprising a logging tool having a coiled tubing logging head provided with logging signal conductors, a wired upper deployment bar having logging signal conductors, a flow-by housing having located therein at least one logging instrument connected with said logging signal conductors, the flow-by housing defining at least one production flow passage permitting flow of production fluid therethrough, said downhole tool further comprising a re-settable packer;

positioning the downhole flow rate measurement tool to locate said re-settable packer at a first pre-selected depth above the bottommost perforated zone or lateral branch;

inflating said re-settable packer to sealing engagement with the wellbore;

measuring the production flow rates of oil, water, and gas in the wellbore at the pre-selected depth; and correlating the production flow rate data of individual measurements for identification of the individual production flow rates of the individual perforated zones and/or lateral branches.

* * * * *